United States Patent [19]

Honma et al.

[11] 4,159,290

[45] Jun. 26, 1979

[54] VARIABLE STAGE TYPE CARBURETOR

[75] Inventors: Kiyomi Honma; Yoshikazu Aochi, both of Katsuta; Takao Teranishi, Hitachi; Kenichi Chonan, Katsuta, all of Japan

[73] Assignee: Hitachi, Ltd., Japan

[21] Appl. No.: 913,057

[22] Filed: Jun. 6, 1978

[30] Foreign Application Priority Data

Jun. 10, 1977 [JP] Japan ..... 52-69053

[51] Int. Cl.[2] ..... F02M 9/08

[52] U.S. Cl. ..... 261/44 F; 261/52

[58] Field of Search ..... 261/44 F, 52

[56] References Cited

U.S. PATENT DOCUMENTS

| | | | |
|---|---|---|---|
| 3,151,189 | 9/1964 | McSeveny | 261/52 |
| 3,291,462 | 12/1966 | Mennesson | 261/52 |
| 3,322,408 | 5/1967 | Stoltman | 261/52 |
| 3,937,768 | 2/1976 | Bier et al. | 261/44 F |
| 4,005,161 | 1/1977 | Shimo et al. | 261/44 F |
| 4,105,720 | 8/1978 | Hohsho et al. | 261/44 F |
| 4,119,684 | 10/1978 | Karino | 261/44 F |

*Primary Examiner*—Tim R. Miles

*Attorney, Agent, or Firm*—Craig and Antonelli

[57] ABSTRACT

A variable stage type carburetor having an intake passage, a throttle valve disposed in the intake passage, and a movable vane disposed at the upstream side of the throttle valve, the movable vane being adapted to cooperate with the wall of the intake passage in constituting a variable venturi and operatively connected to the throttle valve, so as to be moved in response to the movement of the throttle valve. The carburetor further has a first vane controller adapted for displacing the movable vane in the closing direction, independently of the throttle valve, when the venturi vacuum is lowered, and a second vane controller adapted to displace the movable vane in the closing direction, also independently of the throttle valve, when the force exerted by the intake air flow on the movable vane drops below a predetermined level.

19 Claims, 10 Drawing Figures

VARIABLE STAGE TYPE CARBURETOR

BACKGROUND OF THE INVENTION

This invention relates to a variable stage type carburetor and particularly to a variable stage type carburetor which can prevent a lean mixture charge at the time when the associated engine is operated with heavy load.

A variable stage type carburetor contemplates that the opening area of a venturi portion defined between a movable vane and the inner wall of an intake passage is varied by the movable vane operatively connected to a throttle valve via a link mechanism so that the venturi vacuum is controlled, while a fuel metering area is varied through cooperation of a jet needle connected to the movable vane with an orifice provided in the venturi wall surface confronting the vane so that an air-fuel ratio is controlled to a given value. This type of carburetor can set the venturi vacuum at a considerably high value and has an excellent fuel atomizing characteristics.

In the conventional variable stage type carburetors, however, the venturi vacuum is inconveniently lowered as the intake air flow rate is reduced, because the opening degree of the movable vane is held corresponding to the opening degree of the throttle valve, irrespective of the intake air flow rate. Thus, when a heavy load is applied to the engine associated with this type of carburetor, the revolution speed of the engine shaft is lowered to decrease the intake air flow rate, so that the venturi vacuum is lowered. Consequently, the amount of fuel induced into the intake air flow is reduced to make the air-fuel mixture lean, resulting in a lowered engine output.

In this connection, the specification of U.S. Pat. No. 4,005,161 (Shoji Shimo et al) discloses an improved carburetor of the variable stage type. This carburetor has a vane controller adapted to move the movable vane, the opening degree of which is changed in direct proportion to the opening degree of the throttle valve, further toward the closing position, in response to the lowering of the venturi vacuum. In this improved carburetor, however, the vane controller is designed such that it is turned into effect only when the opening degree of the throttle valve exceeds a predetermined opening degree, since it is extremely difficult to obtain a good functioning of the vane controller over entire range of opening degree of the throttle valve.

Thus, the vane controller is not effective when the throttle valve has not been opened beyond the predetermined opening degree. Therefore, when the intake air flow rate is decreased during the engine operation with the throttle valve opening degree not exceeding the predetermined opening degree, the venturi vacuum is excessively lowered to render the mixture extremely lean, resulting in a deteriorated or unstable engine operation and, in the worst case, stalling of the engine. At the same time, a malfunctioning of the engine may be caused by an extraordinary drop of venturi vacuum attributable to a lowering of the intake air flow rate beyond the range of the effectiveness of the vane controller.

The U.S. Patent Ser. No. 828,670 (K. Karino et al) filed on Aug. 29, 1977, U.S. Pat. 4,105,720 is concerned with a carburetor having a vane controller and an acceleration pump in combination. Although the acceleration pump can compensate for the decrease of the fuel supply rate to some extent, when the intake air flow rate is extraordinarily lowered during the engine operation with small throttle valve opening degree, this carburetor is still unable to provide an ultimate satisfaction.

SUMMARY OF THE INVENTION

It is therefore an object of the invention to provide an improved carburetor of variable stage type, which can prevent the air-fuel mixture from becoming unacceptably lean, when the intake air flow rate is extraordinarily lowered.

It is another object of the invention to provide a variable stage type carburetor having a vane controller adapted to be operated in response to the change of the venturi vacuum, capable of preventing the air-fuel mixture from becoming unacceptable lean, when the opening degree of the throttle valve is so small that the vane controller has not been turned into effect.

It is still another object of the invention to provide a variable stage type carburetor capable of preventing the air-fuel mixture from becoming unacceptably lean, at any opening of the throttle valve.

It is a further object of the invention to provide a variable stage carburetor which can ensure a good maneuverability of the engine even in the heavy load and low speed range of engine operation.

It is a still further object of the invention to provide a variable stage type carburetor having means for moving a movable vane by a predetermined distance in the closing direction upon detection of an extraordinary lowering of the intake air flow rate.

To these ends, according to the invention, there is provided a variable stage type carburetor comprising: an intake passage, a throttle valve disposed in the intake passage, a movable vane rotatably mounted in the intake passage at a portion of the latter upstream from the throttle valve, the movable vane cooperating with the wall of the intake valve in defining a variable venturi, a linking mechanism through which the movable vane is operatively connected to the throttle valve, a first vane controller adapted to cause the movement of the movable vane in the closing direction in response to the lowering of the venturi vacuum, and a second vane controller adapted to displace the movable vane in the closing direction when the force exerted by the intake air flow on the movable vane is decreased to a level below a predetermined level.

These and other objects, as well as advantageous features of the invention will become clear from the following description of the preferred embodiments taken in conjunction with the accompanying drawings in which:

DESCRIPTION OF THE PREFERRED EMBODIMENTS

Figure 1:
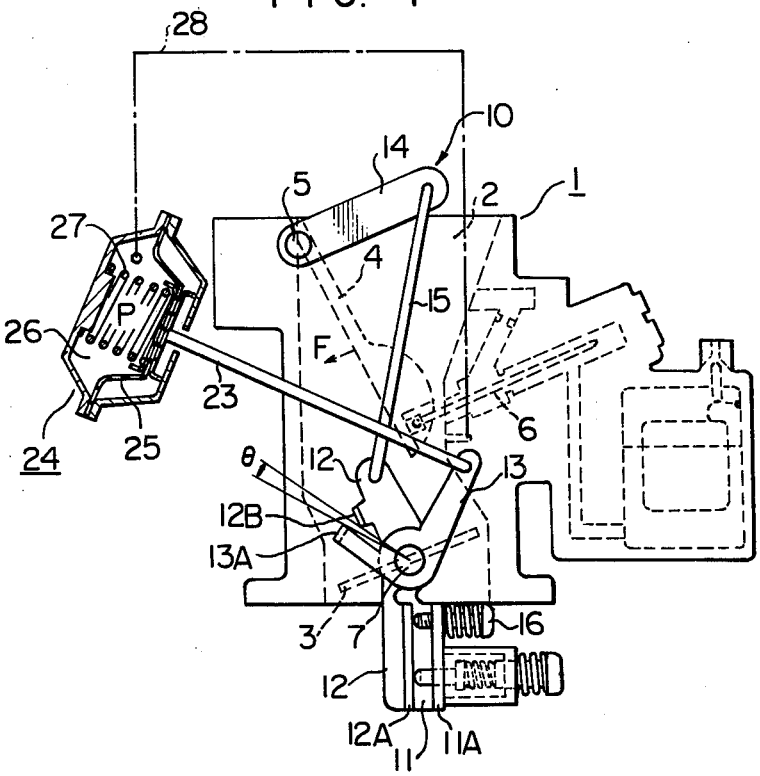
FIG. 1 is a side elevational view of an embodiment of the invention.
Figure 2:
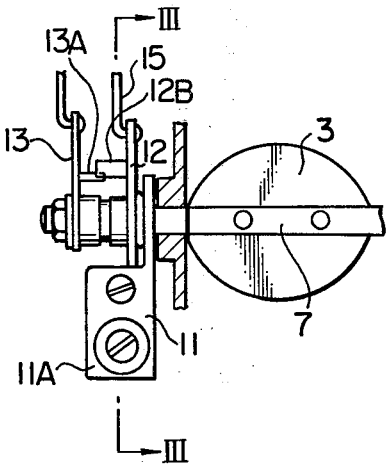
FIG. 2 is a side elevational view of a throttle valve shaft and levers connected to the throttle valve shaft.
Figure 3:
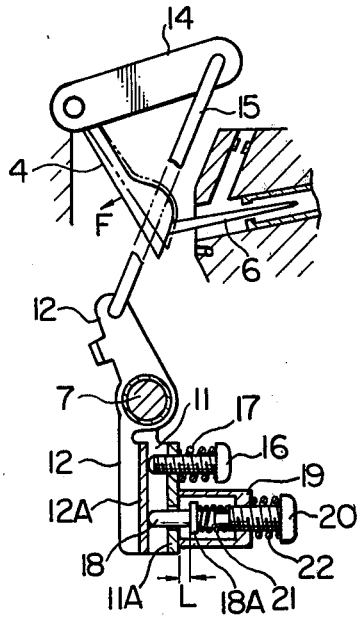
FIG. 3 is a sectional view taken along the line III—III of FIG. 2, showing a venturi portion in section.

Referring first to FIGS. 1, 2 and 3 showing a preferred embodiment of the invention, a carburetor generally designated by a reference numeral 1 has an intake passage 2 in which disposed are a throttle valve 3 and a movable vane 4. The movable vane 4 is carried at its upper end by a rotatable vane shaft 5, and cooperate at its lower end with the wall of the intake passage 2 in defining a variable venturi. Since the movable vane 4 is fixed to the vane shaft 5 at its upper end, a force F, which acts to bias the movable vane 4 for a larger venturi area, is exerted by the intake air flow on the movable vane 4.

A jet needle 6 connected to the free end of the vane 4 is adapted to adjust or regulate the fuel discharge rate in response to the movement of the movable vane 4.

The throttle valve 3 is fixed to a throttle valve shaft 7 which is supported rotatably. The throttle valve shaft 7 is operatively connected to the vane shaft 5 by means of a linking mechanism 70. The linking mechanism includes an adjust lever 11 fixed to the throttle valve shaft 7, a connecting lever 12 and a control lever 13 which are rotatably supported by the throttle valve shaft 7, another connecting lever 14 fixed to the vane shaft 5, and a rod 15 through which both connecting levers 12, 14 are connected to each other. The adjust lever 11 has a flattened area 11A extending in the axial direction of the throttle valve shaft 7 and engaged by an adjusting screw 16. A reference numeral 17 denotes a spring for preventing the adjusting screw from becoming loosened.

The connecting lever 12 also has a flattened area 12A extending in the axial direction of the throttle valve shaft 7. The flattened area 12A is abutted by the end of the adjusting screw 16, so as to prevent the connecting lever 12 from rotating counter-clockwise as viewed on FIG. 1 with respect to the adjust lever 11. In other words, the arrangement is such that the movement of the movable vane 4 in the opening direction is checked by the mutual engagement of the flattened area 12A and the end of the adjusting screw 16.

At the same time, since the movable vane 4 is subjected, as stated before, to the force F which acts to bias the movable vane 4 for a larger opening degree, the force F is transmitted through the lever 14 and the rod 15 to the connecting lever 12, so that the flattened area 12A is biased into contact with the end of the adjusting screw 16.

Consequently, the movable vane 4 is always held at an opening degree corresponding to the opening degree of the throttle valve 3, and is displaced in response to the movement of the throttle valve 3. The opening degree of the movable vane 4 can be adjustably set in relation with the opening degree of the throttle valve 3, by means of the adjusting screw 16.

As will be most clearly seen from FIG. 3, the flattened area 11A of the adjust lever 11 is held by a held-equipped rod 18 movably in parallel with the adjusting screw 16. More specifically, the rod 18 is pressed onto the flattened area 12A of the connecting lever 12, by means of an adjusting screw 20 screwed into a housing 19 and a coiled spring 21 acting between the adjusting screw 20 and the rod 18. A spring for preventing the adjusting screw 20 from becoming loosened is designated at a reference numeral 22.

The force of the spring 21 is so selected and adjusted as to displace the movable vane 4 in the closing direction, overcoming the force F acting on the same, when the venturi vacuum is extraordinarily lowered due to an extraordinary lowering of the intake air flow rate. Namely, when the level of the force F is larger than the predetermined level Fo, the connecting lever 12 is positioned to keep a contact at its flattened area 12A with the end of the adjusting screw 16, depressing the rod 18. However, when the level of the force F drops below the level Fo, the rod 18 is projected leftward by the coiled spring 21, so as to rotate the connecting lever 12 clockwise, thereby to move the movable vane 4 in the closing direction to the position shown by broken lines.

The maximum displacement of the rod 18 is limited to L, because of the provision of a head 18A on the rod 18. Consequently, the maximum displacement of the movable vane 4 in the closing direction is also limited to a value corresponding to L.

Turning again to FIG. 1, the control lever 13 is provided at its one end with a projection or a tab 13A engageable with a tab 12B formed on the connecting lever 12, so as to limit the maximum opening degree of the movable vane 4, when the latter is moved in the opening direction accompanying the opening movement of the throttle valve 3. In other words, the movable vane 4 is adapted to be moved in the closing direction, irrespective of the opening degree of the throttle valve 3, by a clockwise rotation of the control lever 13.

A vane controller 24 is operatively connected to one end of the control rod 13, through a medium of a rod 23. The vane controller 24 includes a diaphragm 25 connected to the rod 23, a vacuum chamber 26 and a coiled spring 27.

The vacuum chamber 26 communicates the venturi portion of the intake passage through a conduit 28. The diaphragm is adapted to be deflected in a response to the vacuum P in the vacuum chamber 26, i.e. to the venturi vacuum, so as to rotate the control lever 13 around the throttle valve shaft 7. The force of the coiled spring 27 is so selected as to bias the diaphragm 25 to the position as shown in FIG. 1, when the vacuum P in the vacuum chamber 26 is lower than a predetermined vacuum $P_1$. Thus, the diaphragm 25 is deflected to compress the coiled spring 27, as the vacuum P grows larger beyond the predetermined vacuum $P_1$, thereby to rotate the control lever 13 counter-clockwise.

The level of the predetermined vacuum $P_1$ is so selected as to be slightly smaller than the vacuum $P_o$ established at the venturi portion in the normal running condition to the engine associated with the carburetor, i.e. at a substantially same level as the venturi vacuum generated when the intake air flow rate is decreased by a lowering of the engine speed. At the same time, the level of the vacuum $P_1$ is selected to be larger than the level of the venturi vacuum $P_2$ at which the movable vane 4 is displaced to the position as shown by broken lines in FIG. 3.

FIG. 1 shows the carburetor in a state in which the throttle valve 3 is positioned at the idling position, so that the venturi vacuum is lower than the aforesaid predetermined vacuum $P_1$.

As will be clearly seen from this Figure, the tab 13A of the control lever 13 and the tab 12B of the connecting lever 12 are angularly spaced from each other by an angle $\theta$ around the throttle valve shaft 7. Therefore, the rotation of the connecting lever 12 is never hindered by the control lever 13, until the rotation angle of the throttle valve 3 from the illustrated idling position comes to exceed the angle $\theta$. This means that the vane controller 24 is kept inactive as long as the throttle valve opening is small enough to fall within the range of the rotation angle $\theta$. The angle $\theta$ is preferably selected to be $\frac{1}{4}$ to $\frac{1}{3}$ of the full opening angle of the throttle valve.

Figure 9:
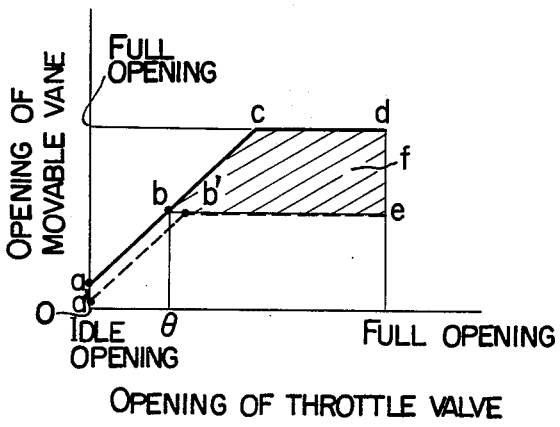
FIG. 9 is a graphical representation of the characteristics of the embodiment as shown in FIG. 1.

In operation, referring to FIG. 9, the venturi vacuum P is greater than the vacuums $P_1$ and $P_2$, under the normal running condition of the engine associated with the carburetor, so that the control lever 13 is biased counterclockwise further from the position shown in FIG. 1, where it does not hinder the rotation of the connecting lever 12, and the flattened area 12A of the connecting lever 12 is kept in contact with the end of the adjusting screw 16 of the adjust lever 11.

In this condition, the rotation of the throttle valve 3 is transmitted to the movable vane 4, through the adjust lever 11, connecting lever 12, rod 15 and the connecting lever 14, so that the opening degree of the movable vane 4 is changed substantially in proportion to the change of the opening degree of the throttle valve 3, as shown by a curve a-b-c of FIG. 9.

The throttle valve 3 is allowed to further open independently of the movable vane 4, after the latter has been opened to its maximum opening degree, as shown by a curve c-d.

As the engine speed is lowered by a heavy load applied to the engine, the intake air flow rate through the intake passage 2 is decreased to lower the venturi vacuum, resulting in a lowered level of the venturi vacuum P. Consequently, the vacuum force acting on the diaphragm 25 of the vane controller 24 is overcome by the force of the coiled spring, so as to allow a deflection of the diaphragm 25, thereby to cause a clockwise rotation of the control lever 13 as viewed in FIG. 1. Assuming that the throttle valve 3 has been opened beyond the angle $\theta$, this clockwise rotation of the control lever 13 causes a clockwise rotation of the connecting lever 12, so that the movable vane 4 is rotated in the closing direction irrespective of the opening degree of the throttle valve 3, thereby to prevent the venturi vacuum from becoming low. The opening degree of the movable vane 4 in this condition is within the hatched region f in FIG. 9.

In case that an extremely heavy load is applied to engine to extraordinarily lower the intake air flow rate, the venturi vacuum is also lowered extraordinarily. As the venturi vacuum drops below the vacuum level $P_2$, the force F acting on the movable vane 4 in the opening direction of the latter is correspondingly decreased, so that the connecting lever 12 is rotated clockwise, irrespective of the throttle valve 3, as shown in FIG. 3 and, accordingly, the movable vane 4 is displaced in the closing direction. Due to this displacement of the movable vane in the closing direction, the venturi vacuum is made larger to avoid the extraordinary drop of the same vacuum which might, for otherwise, caused by the decrease of the intake air flow rate. In this condition, the opening degree of the movable vane 4 is within the region confined by the lines a-b-b'-a' or on the line b'-e of FIG. 9.

It will be seen that, according to the described embodiment of the invention, the extraordinary drop of the venturi vacuum attributable to an extraordinary decrease of the intake air flow rate is prevented, because the movable vane is forcibly displaced in the closing direction by the rod 18 and the coiled spring 21, so that the lean mixture charge is fairly avoided. Consequently, the aforementioned problems peculiar to the low speed and heavy load operation are completely overcome.

Figure 4:
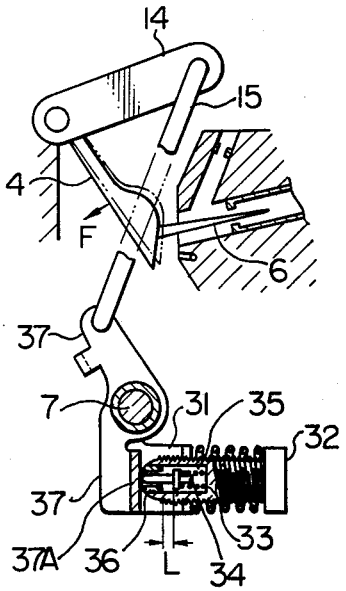
FIG. 4 is a view similar to that of FIG. 3 but showing another embodiment.

FIG. 4 shows a modification of the carburetor as shown in FIG. 1, in which an adjust screw 32 screwed to an adjust lever 31 is provided at its one end with a hole 33 slidably receiving a flanged rod 34. A coiled spring 35 is disposed between the flange of the rod 34 and the bottom of the hole 33. A stopper 36 for limiting the projectable length of the rod 34 is fixed to the entrance portion of the hole 33. A connecting lever 37 carried by the throttle valve shaft 7 has a flattened area 37A engageable with the stopper 36 of the adjust screw 32 and with the rod 34. Other portions of this embodiment than described above are materially identical to those of the embodiment as shown in FIG. 1 and, therefore, are not detailed here.

The connecting lever 37 of this embodiment is also kept normally in contact with the stopper 36 of the adjust screw 32, and the movable vane 4 is kept in the position as shown by full lines. However, when the venturi vacuum is lowered extraordinarily, the rod 34 comes to project out of the adjust screw 32, so as to rotate the connecting lever 37 clockwise, thereby to displace the movable vane 4 to the position of broken lines, overcoming the force F exerted by the intake air flow, effectively preventing an extraordinary drop of the venturi vacuum.

Figure 5:
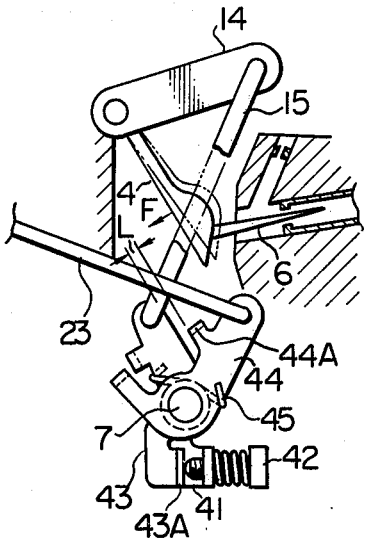
FIG. 5 is a partially sectioned side elevational view of still another embodiment.

Referring now to FIG. 5 showing still another embodiment, an adjusting screw 42 solely is supported by the adjust lever 41 fixed to the throttle valve shaft 7. A torsion spring 45 disposed between a connecting lever 43 rotatably carried by the shaft 7 and a control lever 44. The torsion spring 45 is adapted to bias the connecting lever 43 clockwise with respect to the control lever 44. The force of the torsion spring 45 is so selected as to allow the closing of the movable vane 4 to the position as shown by broken lines, overcoming the force F exerted by the intake air flow, only when the venturi vacuum is changed to an extraordinary low level.

A stopper 44A formed on the control lever 44 is adapted to limit the clockwise rotation of the connecting lever 43. Other portions of this embodiment than specifically mentioned above are all identical to those of the embodiment as shown in FIG. 1 and, therefore, the detailed description of these parts are neglected.

Figure 10:
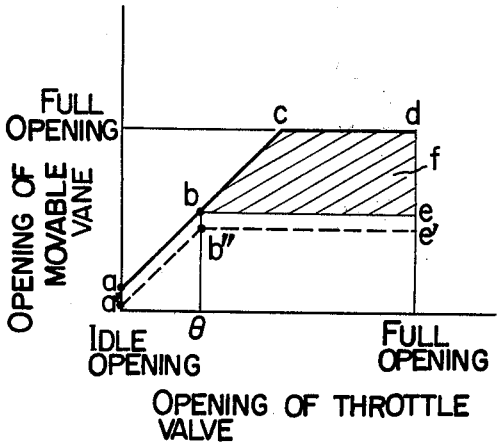
FIG. 10 is a graphical representation of the characteristics of the embodiment as shown in FIG. 10.

In the normal running condition of the engine, the intake air flow imparts to the connecting lever 43 a force F large enough to overcome the torque exerted by the torsion spring 45, so that the flattened area 43A of the connecting lever 43 is kept in contact with the adjusting screw 42. Consequently, the movable vane 4 is kept opened to the opening degree corresponding to the opening degree of the throttle valve 3. In this condition, the opening degrees of the movable vane and the throttle valve are changed following the curve a-b-c-d of FIG. 10.

As an intake air flow rate decreases, the vane controller (not shown) is turned into effect as is the case of the embodiment as shown in FIG. 1, so as to decrease the opening degree of the movable vane 4. The opening degree of the vane in this condition resides in the hatched area f of FIG. 10.

As the intake air flow rate is further decreased, the connecting lever 43 is rotated clockwise, with respect to the control lever 44, by the force of the torsion spring 45, so that the movable vane 4 is further displaced in the closing direction. The relationship between the opening degrees of the throttle valve 3 and the movable vane 4 are shown by a curve a'-b''-e' of FIG. 10.

Thus, the movable vane 4 is solely displaced in the closing direction, so that the drop of the venturi vacuum is avoided even when the intake air flow rate is extraordinarily lowered.

Figure 6:
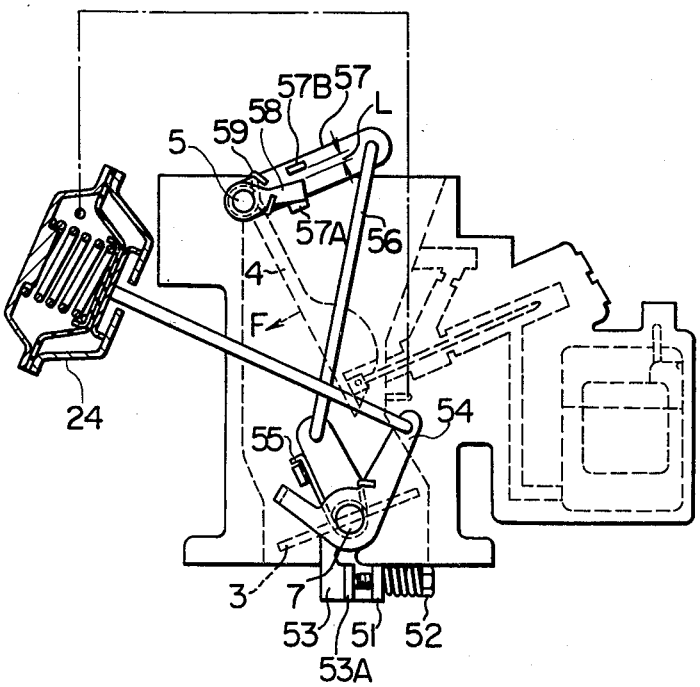
FIG. 6 is a side elevational view of a further embodiment.

FIG. 6 shows a further embodiment of the invention. In this embodiment, as in the embodiment of FIG. 5, an adjusting screw 52 is solely supported by an adjust lever 51 fixed to the throttle valve shaft 7. However, in good contrast to the embodiment as shown in FIG. 5, a torsion spring is disposed between a connecting lever 53 rotatably held by the throttle valve shaft 7 and a control lever 54, for biasing the connecting lever 53 counter-clockwise. This spring 55 is provided for ensuring the safe engagement of a flattened area 53A of the connecting lever 53 with the adjusting screw 52. The connecting lever 53 is connected through a rod 56 to a connecting lever 57 rotatably carried by the vane shaft 5. A vane lever 58 is fixed to the vane shaft 5. A torsion spring 59 is disposed between the levers 57 and 58, for biasing the lever 58 counter-clockwise. A pair of stoppers 57A and 57B attached to the connecting lever 57 are adapted to limit the rotation angle of the vane lever 58. The force of the torsion spring 59 is so selected as to allow the displacement of the movable vane 4 in the closing direction, only when the force F of the intake air flow is largely decreased by an extraordinary drop of the intake air flow rate. It will be understood by those skilled in the art that this embodiment provides the same characteristic as that shown in FIG. 10.

Figure 7:
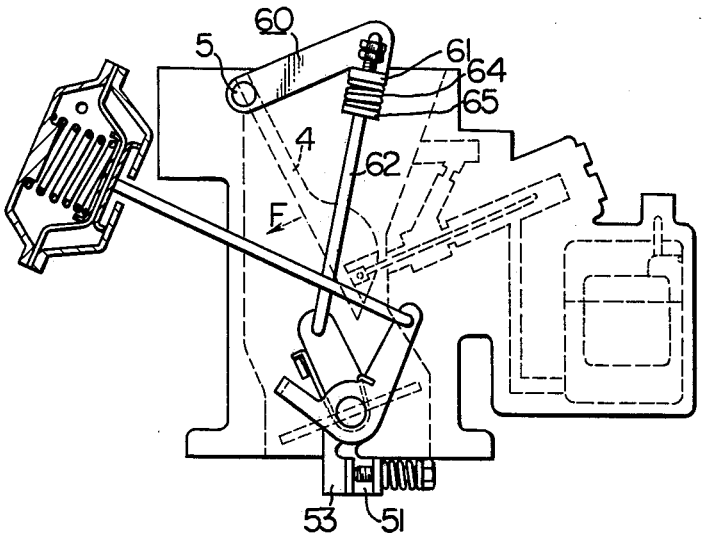
FIG. 7 is a side elevational view of a still further embodiment.
Figure 8:
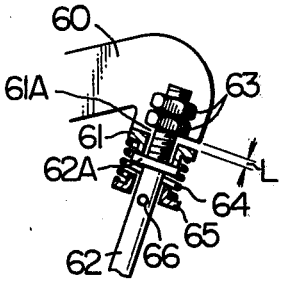
FIG. 8 is a sectional view of a part encircled by a circle VIII of FIG. 7.

FIGS. 7 and 8 show a modification of the embodiment as shown in FIG. 6. A connecting lever 60, which is fixed to the vane shaft 5, is provided at its one end with a flange 61 having a bore 61A. The bore 61A movably receives a rod 62 which is connected at its one end to the connecting lever 53. Thus, the lever 60 is movable relatively to the rod 62. In order to limit the displacement of the lever 60 with respect to the rod 62, a flange 62A is formed on the rod 62, so as to engage a stopper nut 63 screwed onto the end of the rod 62.

Since the force F is exerted on the movable vane 4 by the intake air flow, so as to open the movable vane 4, the flange 61 of the connecting lever 60 is held in contact with the flange 62A of the rod 62, so that the connecting lever 60 and the rod 62 are moved as if they are unitary with each other. In order to cause a displacement of the movable vane 4 in the closing direction when the force F acting on the movable vane 4, provided are a coiled spring 64 and a spring retainer 65 around the rod 62. The spring retainer 65 is prevented from moving axially, by a pin 66 fixed to the rod 62.

This embodiment functions in the same manner as the embodiment as shown in FIG. 6, so as to displace the movable vane 4 in the closing direction, thereby to prevent the venturi vacuum from becoming low, when the intake air flow rate is lowered extraordinarily.

What is claimed is:

1. A variable stage type carburetor comprising: an intake passage, a throttle valve disposed in said intake passage, a movable vane mounted rotatably in said intake passage at a portion of the latter upstream from said throttle valve, said movable vane cooperating with the wall of said intake passage in defining a variable venturi, a linking mechanism through which said movable vane is operatively connected to said throttle valve, a first vane controller adapted to cause a displacement of said movable vane in the closing direction in response to the lowering of the venturi vacuum, and a second vane controller adapted to displace said movable vane in the closing direction when the force exerted by the intake air flow on said movable vane drops below a predetermined level.

2. A variable stage type carburetor as set forth in claim 1, wherein said linking mechanism includes an adjust lever fixed to a throttle valve shaft rigidly supporting said throttle valve, a connecting lever rotatably mounted on said throttle valve shaft, means for connecting said movable vane to said connecting lever such that said vane may be rotated in response to the rotation of said connecting lever, first biasing means adapted to limit the rotation of said connecting lever with respect to said adjust lever in the direction for opening said movable vane, so as to keep said connecting lever at a predetermined position in relation to said adjust lever, while said second vane controller includes second biasing means adapted to displace said connecting lever in relation to said adjust lever in the direction for closing said movable vane, when said force exerted on said movable vane drops below said predetermined level.

3. A variable stage type carburetor as set forth in claim 2, wherein said first biasing means include an adjusting screw screwed to said adjust lever, while said second biasing means include a rod held by said adjust lever movably in parallel with said adjusting screw, and spring means adapted to press said rod onto said connecting lever.

4. A variable stage type carburetor as set forth in claim 3, wherein said rod has a flange adapted for limiting the stroke of movement of said rod in relation to said adjust lever.

5. A variable stage type carburetor as set forth in claim 3, characterized by further comprising means for adjusting the biasing force of said spring means.

6. A variable stage type carburetor as set forth in claim 2, wherein said first biasing means include an adjusting screw screwed to said adjust lever, said adjusting screw having an axial bore formed through its end wall confronting said connecting lever, while said second biasing means include a rod mounted in said adjusting screw through said axial bore, and spring means adapted for pressing said rod onto said connecting lever.

7. A variable stage type carburetor as set forth in claim 6, wherein said second biasing means further include a stopper for limiting the length by which said rod projects from said adjusting screw.

8. A variable stage type carburetor as set forth in claim 2, wherein said first vane controller includes a control lever rotatably supported by said throttle valve shaft, and a vane controller actuator adapted to rotate said control lever in response to the change of said venturi vacuum, said control lever being disposed such that it can rotate said connecting lever only in the direction for closing said movable vane.

9. A variable stage type carburetor as set forth in claim 8, wherein said first vane controller is effective only when said throttle valve has been opened beyond a predetermined opening degree.

10. A variable stage type carburetor as set forth in claim 9, wherein said first biasing means include an adjusting screw screwed to said adjust lever, while said second biasing means include a rod held by said adjust lever movably in parallel with said adjusting screw and spring means adapted to press said rod onto said connecting lever.

11. A variable stage type carburetor as set forth in claim 10, wherein said rod has a flange adapted for limiting the stroke of movement of said rod in relation to said adjust lever.

12. A variable stage type carburetor as set forth in claim 11, wherein said second biasing means further includes means for adjusting the biasing force of said spring means.

13. A variable stage type charburetor comprising: an intake passage, a throttle valve disposed in said intake passage, a movable vane rotatably mounted in said intake passage at a portion of the latter upstream from said throttle valve, said movable vane cooperating with the wall of said intake passage in defining a variable venturi, a linking mechanism through which said movable vane is operatively connected to said throttle valve, a first vane controller adapted to displace said movable vane in the closing direction in response to the lowering of the venturi vacuum, and a second vane controller adapted to further displace said movable vane in the closing direction from the position determined by the opening degree of said throttle valve and by said first vane controller, when a force exerted by the intake air flow on said movable vane drops below a predetermined level.

14. A variable stage type carburetor as set forth in claim 13, wherein said second vane controller includes a connecting lever rotatably mounted on a vane shaft carrying said movable vane and connected to said throttle valve and said first vane controller so as to be displaced to a position determined by the opening degree of said throttle valve and by said first vane controller, a vane lever rigidly supported by said vane shaft, stopper means adapted for limiting the angular range over which said vane lever is rotatable in relation to said connecting lever, and spring means disposed between said connecting lever and said vane lever and adapted for biasing said vane lever in the direction for closing said movable vane.

15. A variable stage type carburetor as set forth in claim 14, wherein said spring means include a torsion spring.

16. A variable stage type carburetor as set forth in claim 13, wherein said second vane controller includes a connecting lever rigidly connected to a vane shaft carrying said movable vane, a rod movable in relation to said connecting lever, said rod being connected to said throttle valve and said first vane controller so as to be moved to a position determined by the opening degree of said throttle valve and said first vane controller, stopper means adapted for limiting the stroke of movement of said rod in relation to said connecting lever, and spring means disposed between said connecting lever and said rod and adapted for biasing said connecting lever in the direction for closing said movable vane.

17. A variable stage type carburetor as set forth in claim 14, characterized in that: said stopper means include a nut engaging a threaded portion of said rod, whereby said stroke for movement of said rod in relation to said connecting lever is rendered adjustable.

18. A variable stage type carburetor as set forth in claim 13, wherein said linking mechanism includes an adjust lever fixed to a throttle valve shaft ridigly supporting said throttle valve, a connecting lever rotatably supported by said throttle valve shaft, means for operatively connecting said movable vane to said connecting lever, such that said movable vane is rotated in response to the rotation of said connecting lever, and means for limiting the rotation of said connecting lever in the direction for opening said movable vane, so as to hold said connecting lever at a predetermined position in relation to said adjust lever; that said first vane controller includes a control lever rotatably carried by said throttle valve shaft and adapted for rotating said connecting lever in the direction for closing said movable vane, and a vane controller actuator connected to said control lever so as to cause a rotation of said control lever in response to the change of the venturi vacuum; and that said second vane controller includes spring means disposed between said connecting lever and said control lever and adapted for biasing said connecting lever in the direction for closing said movable vane.

19. A variable stage type carburetor as set forth in claim 18, wherein said control lever has a stopper adapted to limit the rotation of said connecting lever in the direction for closing said movable vane.

* * * * *